US008899164B2

(12) United States Patent
Magara et al.

(10) Patent No.: US 8,899,164 B2
(45) Date of Patent: Dec. 2, 2014

(54) EMBROIDERY FRAME TRANSPORT DEVICE AND SEWING MACHINE

(71) Applicants: Midori Magara, Nagoya (JP); Katsuhisa Hasegawa, Kitanagoya (JP)

(72) Inventors: Midori Magara, Nagoya (JP); Katsuhisa Hasegawa, Kitanagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/081,383

(22) Filed: Nov. 15, 2013

(65) Prior Publication Data

US 2014/0144360 A1 May 29, 2014

(30) Foreign Application Priority Data

Nov. 29, 2012 (JP) ..... 2012-261634

(51) Int. Cl.

| | |
|---|---|
| ***D05B 21/00*** | (2006.01) |
| ***D05C 9/06*** | (2006.01) |
| ***D05B 69/12*** | (2006.01) |
| *D05B 39/00* | (2006.01) |

(52) U.S. Cl.

CPC . *D05C 9/06* (2013.01); *D05B 69/12* (2013.01)
USPC ..... 112/470.18

(58) Field of Classification Search

CPC ..... D05B 21/00; D05B 3/04; D05B 3/243; D05B 19/16; D05B 31/00; D05B 39/00; D05C 9/00; D05C 9/02; D05C 9/04; D05C 9/06
USPC ..... 112/102, 103, 102.5, 470.06, 470.18, 112/470.09, 470.14; 38/102.91, 102
See application file for complete search history.

(56) References Cited

U.S. PATENT DOCUMENTS

| | | | | |
|---|---|---|---|---|
| 875,626 | A * | 12/1907 | Parkes | 112/98 |
| 3,695,194 | A * | 10/1972 | Heimann | 112/470.18 |
| 3,750,186 | A * | 7/1973 | Sakamoto | 346/33 MC |
| 4,434,880 | A * | 3/1984 | Kornatowski | 192/69.1 |
| 4,598,655 | A * | 7/1986 | Takenoya | 112/103 |
| 4,955,247 | A * | 9/1990 | Marshall | 74/347 |
| 7,258,071 | B2 * | 8/2007 | Shoji | 112/470.18 |
| 8,082,866 | B2 * | 12/2011 | Hirose et al. | 112/470.04 |
| 2013/0074748 | A1 | 3/2013 | Kato et al. | |
| 2013/0199430 | A1 | 8/2013 | Kato | |

FOREIGN PATENT DOCUMENTS

| | | |
|---|---|---|
| JP | A-5-123464 | 5/1993 |
| JP | A-2013-70875 | 4/2013 |
| JP | A-2013-158491 | 8/2013 |

* cited by examiner

*Primary Examiner* — Ismael Izaguirre
(74) *Attorney, Agent, or Firm* — Oliff PLC

(57) ABSTRACT

An embroidery frame transport device includes a carriage, a first drive portion, a drive switching portion, and a rotary drive portion. The carriage is provided with an embroidery frame that is rotatable. The first drive portion includes a first transport mechanism and a first drive source. The first transport mechanism transports the carriage in a first direction. The first drive source drives the first transport mechanism. The drive switching portion shuts off transmission of drive power to the first transport mechanism from the first drive source when the first drive portion transports the carriage to a specified position in the first direction. The rotary drive portion causes the embroidery frame to rotate using the drive power of the first drive source, in a state in which the transmission of the drive power from the first drive source to the first transport mechanism is shut off by the drive switching portion.

7 Claims, 13 Drawing Sheets

EMBROIDERY FRAME TRANSPORT DEVICE AND SEWING MACHINE

CROSS-REFERENCE TO RELATED APPLICATION

This application claims priority to Japanese Patent Application No. 2012-261634, filed Nov. 29, 2012, the content of which is hereby incorporated herein by reference in its entirety.

BACKGROUND

The present disclosure relates to an embroidery frame transport device that transports an embroidery frame and to a sewing machine on which the embroidery frame transport device can be mounted.

An embroidery frame transport device that transports an embroidery frame and a sewing machine on which the embroidery frame transport device can be mounted are known. For example, an automatic sewing machine that is provided with a holding portion is known. The holding portion is provided with a circular outer frame and an inner frame that fits into an inner side of the outer frame, and with a support frame that supports the outer frame and the inner frame. The holding portion can clamp an object on which sewing is performed (hereinafter referred to as a sewing object) between the outer frame and the inner frame and can hold the sewing object in a stretched horizontal state below a sewing needle. The automatic sewing machine is provided with 3 motors. One of the motors moves the holding portion in an X direction. Another of the motors moves the holding portion in a Y direction. Yet another of the motors is provided on the support frame of the holding portion. When the motor provided on the support portion rotates, the holding portion moves rotatingly in the horizontal direction.

SUMMARY

However, in the above-described automatic sewing machine, the motor that causes the holding portion to rotate is provided on the support frame of the holding portion. As a result, the weight of the holding portion is significant. Therefore, when the automatic sewing machine moves the holding portion in the X direction and in the Y direction and then stops the holding portion, there is a case in which it is difficult to stop the holding portion. There is thus a case in which accuracy of a stop position of the holding portion deteriorates.

Various embodiments of the broad principles derived herein provide an embroidery frame transport device and a sewing machine that are capable of improving the accuracy of a stop position of the embroidery frame.

Various embodiments provide an embroidery frame transport device that includes a carriage, a first drive portion, a drive switching portion, and a rotary drive portion. The carriage is provided with an embroidery frame that is rotatable and removal. The embroidery frame is capable of rotating. The first drive portion includes a first transport mechanism and a first drive source. The first transport mechanism transports the carriage in a first direction, and the first drive source is provided separately from the carriage and that drives the first transport mechanism. The drive switching portion shuts off transmission of drive power to the first transport mechanism from the first drive source when the first drive portion transports the carriage to a specified position in the first direction. The rotary drive portion causes the embroidery frame to rotate using the drive power of the first drive source, in a state in which the transmission of the drive power from the first drive source to the first transport mechanism is shut off by the drive switching portion.

Embodiments also provide a sewing machine includes a bed portion. The bed portion is formed such that an embroidery frame transport device is capable of being mounted thereon. The embroidery frame transport device includes a carriage, a first drive portion, a drive switching portion, and a rotary drive portion. The carriage is configured to be removably attached an embroidery frame. The embroidery frame is capable of rotating. The first drive portion includes a first transport mechanism and a first drive source. The first transport mechanism transports the carriage in a first direction, and the first drive source is provided separately from the carriage and drives the first transport mechanism. The drive switching portion shuts off transmission of drive power to the first transport mechanism from the first drive source when the first drive portion transports the carriage to a specified position in the first direction. The rotary drive portion causes the embroidery frame to rotate using the drive power of the first drive source, in a state in which the transmission of the drive power from the first drive source to the first transport mechanism is shut off by the drive switching portion.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. A configuration of a sewing machine 1 will be explained with reference to FIG. 1 to FIG. 3. The lower right side, the upper left side, the lower left side and the upper right side in FIG. 1 respectively correspond to the front side, the rear side, the left side and the right side of the sewing machine 1. The left-right direction of the sewing machine 1 is an X direction, and the front-rear direction is a Y direction (refer to FIG. 3).

Figure 1:
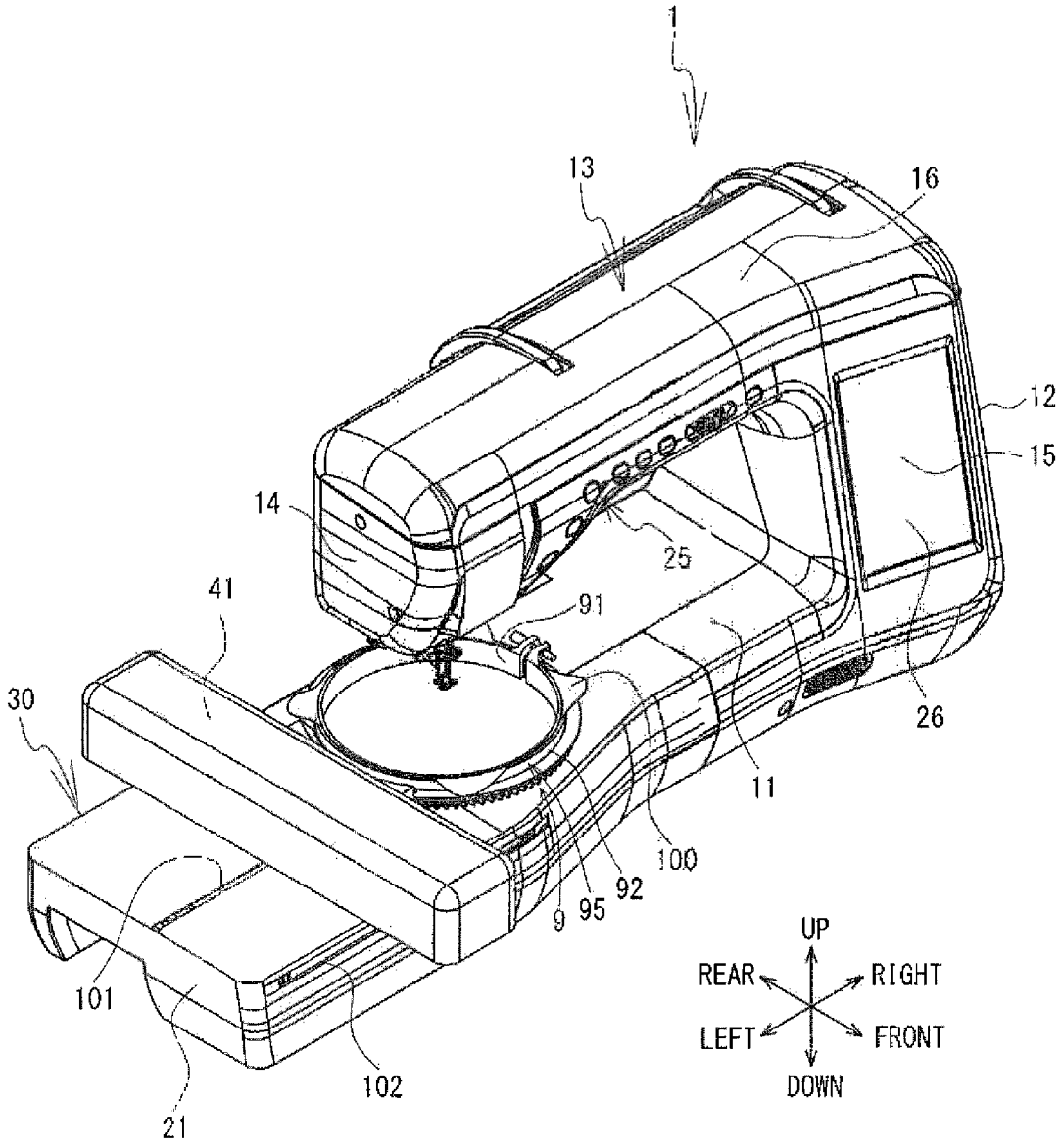
FIG. 1 is a perspective view of a sewing machine on which an embroidery frame transport device is mounted.

As shown in FIG. 1, the sewing machine 1 is provided with a bed portion 11, a pillar portion 12, an arm portion 13 and a head portion 14. The bed portion 11 is a base portion of the sewing machine 1 and extends in the left-right direction. The pillar portion 12 extends upward from the right end portion of the bed portion 11. The arm portion 13 extends to the left from the upper end of the pillar portion 12. The head portion 14 is provided on the left leading end portion of the arm portion 13. A needle plate (not shown in the drawings) is arranged on the top surface of the bed portion 11. A feed dog (not shown in the drawings), a cloth feed mechanism (not shown in the drawings), a feed amount adjustment pulse motor 78 (refer to FIG. 11) and a shuttle mechanism (not shown in the drawings) are provided inside the bed portion 11, underneath the needle plate. The feed dog may feed, by a specified feed amount, a work cloth on which sewing is performed. The cloth feed mechanism may drive the feed dog. The feed adjustment pulse motor 78 may adjust the feed amount.

When embroidery sewing or cut work (to be explained later) is performed on the sewing machine 1, an embroidery frame (an embroidery frame 9, for example), which holds a work cloth, is disposed on the top side of the bed 11. In the sewing machine 1, a sewable area inside the embroidery frame is set depending on a type of the embroidery frame that is mounted on an embroidery frame transport device 30. The embroidery frame transport device 30 that moves the embroidery frame 9 can be mounted on and removed from the bed portion 11.

A needle bar 6 (refer to FIG. 2) and the shuttle mechanism (not shown in the drawings) are driven while the embroidery frame 9 is moved in the X direction and the Y direction and caused to rotate by the embroidery frame transport device 30. In this manner, a pattern sewing operation, in which a specific embroidery pattern is sewn on a work cloth 100 that is held in the embroidery frame 9, and cut work, in which the work cloth 100 is cut into a specific shape, are performed. When a normal pattern that is not an embroidery pattern is sewn, the embroidery frame transport device 30 is removed from the bed portion 11. Then, normal sewing is performed while the work cloth 100 is fed by the feed dog.

As shown in FIG. 1, a vertically rectangular liquid crystal display 15 is provided on the front face of the pillar portion 12. Images of various types of items, such as a plurality of types of patterns, names of commands that cause various types of functions to be performed, and various types of messages may be displayed on the liquid crystal display 15. A transparent touch panel 26 is provided on the front face of the liquid crystal display 15. By using a finger or a special touch pen to touch a position on the touch panel 26 that corresponds to one of the items that are displayed on the liquid crystal display 15, the user can select a pattern to be sewn or a command to be executed.

The configuration of the arm portion 13 will be explained. A switch cluster 25, which includes a sewing start-and-stop switch etc., is provided in the lower part of the front face of the arm portion 13. An opening and closing cover 16 is provided in the top part of the arm portion 13. The opening and closing cover 16 is axially supported such that it can be opened and closed by being rotated about an axis that extends in the left-right direction at the upper rear edge of the arm portion 13. Underneath the opening and closing cover 16, that is, in the interior of the arm portion 13, a thread container portion (not shown in the drawings) is provided that contains a thread spool (not shown in the drawings) that supplies an upper thread. The upper thread that extends from the thread spool is supplied to a sewing needle that is not shown in the drawings, through a thread guard portion that includes a tensioner, a thread take-up spring, and a thread take-up lever that are not shown in the drawings. The tensioner is provided in the head portion 14 and may adjust the thread tension. The thread take-up lever may be driven reciprocally up and down and may pull the upper thread upward. A sewing needle (not shown in the drawings) or a cut work needle 8 (refer to FIG. 2) can be attached to a lower end of the needle bar 6 (refer to FIG. 2) that is provided on a lower portion of the head portion 14. The needle bar 6 may be moved up and down by a needle bar up-and-down moving mechanism (not shown in the drawings) that is provided inside the head portion 14. The needle bar up-and-down moving mechanism may be driven by a drive shaft (not shown in the drawings) that may be rotationally driven by a sewing machine motor 79 (refer to FIG. 11). In other words, the needle bar 6 may be driven by the sewing machine motor 79.

Figure 2:
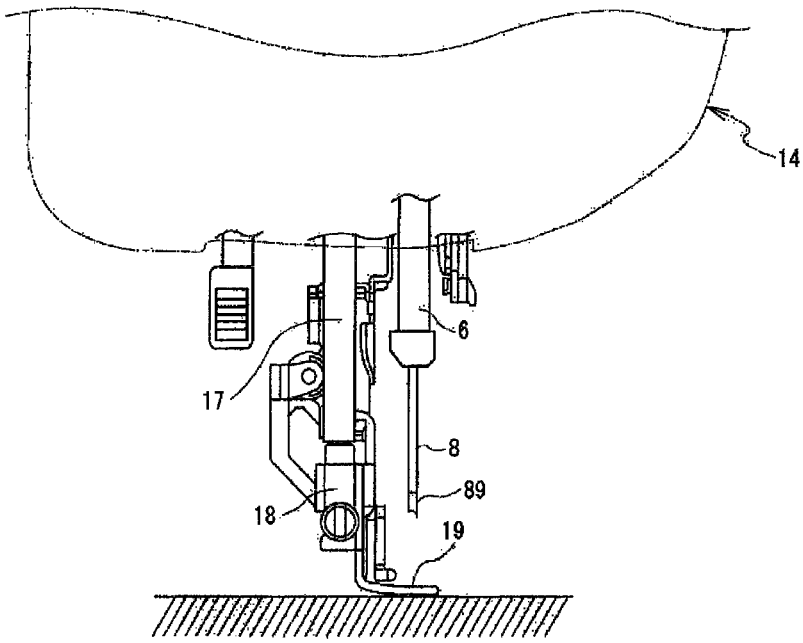
FIG. 2 is a diagram of a vicinity of a sewing needle on which a cutwork needle is mounted, as seen from the left of the sewing machine.

As shown in FIG. 2, the cut work needle 8 is provided with a blade 89 that has a specified width in a specified direction (the front-rear direction in FIG. 2). When the cut work is performed by the cut work needle 8, a cut that has a specified width is formed in the work cloth 100. When the cut work needle 8 has been affixed to the lower end of the needle bar 6, the sewing machine 1 can perform the cut work. When the sewing needle (not shown in the drawings) has been affixed to the lower end of the needle bar 6, the sewing machine 1 can perform the embroidery sewing. A presser bar 17 is provided to the rear of the needle bar 6. A presser holder 18 is attached to the lower end of the presser bar 17. A presser foot 19 that presses down on the work cloth 100 can be attached to and removed from the presser holder 18.

Figure 3:
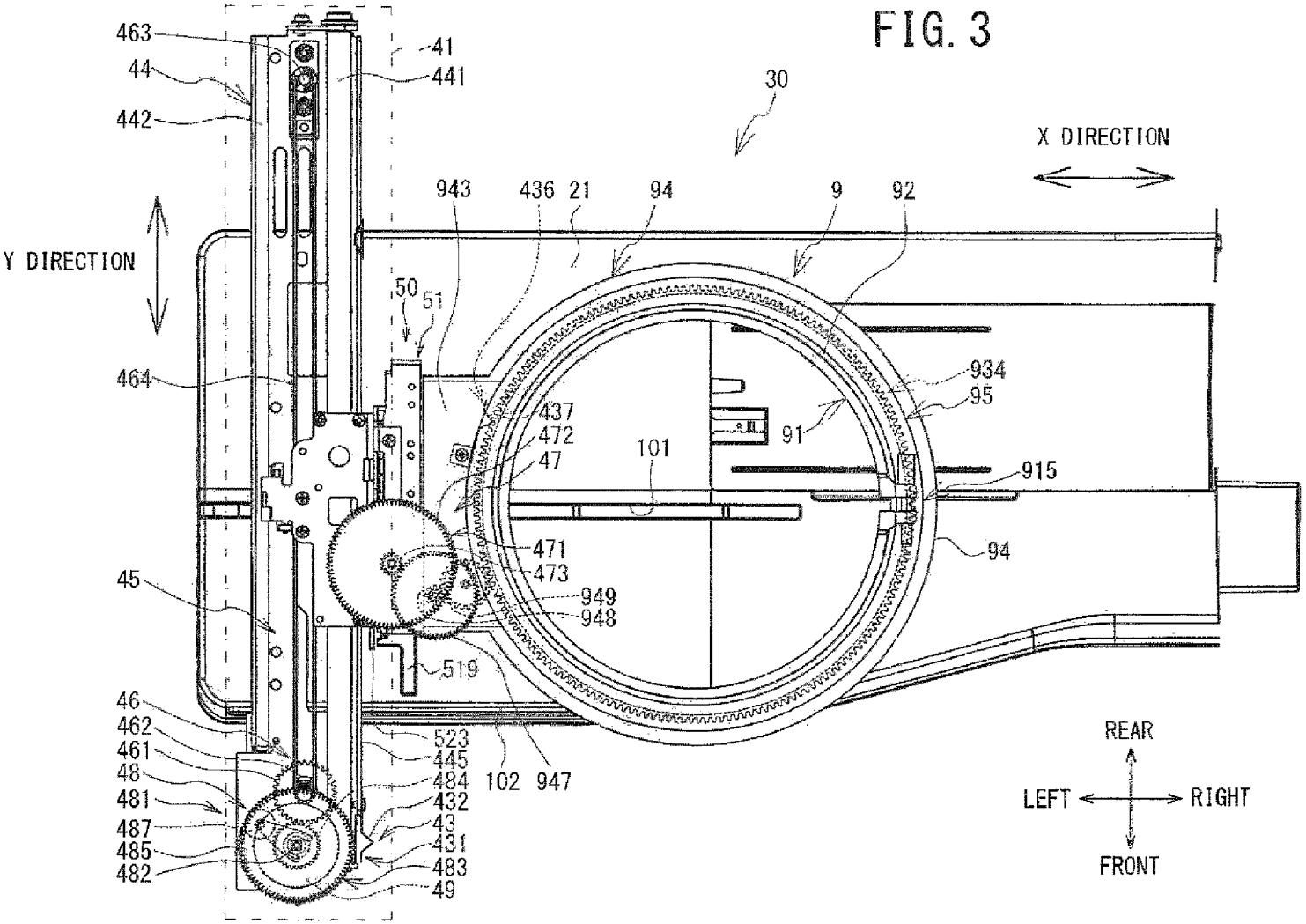
FIG. 3 is a plan view of the embroidery frame transport device showing an internal configuration of a movable case.

As shown in FIG. 1 and FIG. 3, the embroidery frame transport device 30 is provided with a case 21 and a movable case 41. The case 21 has a smooth top surface. The movable case 41 is disposed above the case 21. The movable case 41 is long and thin in the front-rear direction and portions on both ends at the front and rear overhang both ends of the case 21 at the front and rear. When the embroidery frame transport device 30 is mounted on the bed portion 11, a height of the top surface of the case 21 is the same height as a height of the top surface of the bed portion 11. A slit 101 that extends in the left-right direction is provided in a center portion, in the front-rear direction, of the top surface of the case 21. A slit 102 that extends in the left-right direction is provided in an upper portion of the front surface of the case 21. A carriage 50 extends to the right from a first drive mechanism 45 that is provided inside the movable case 41. The embroidery frame 9 is mounted on the carriage 50. The carriage 50 and the embroidery frame 9 are positioned above the case 21.

An internal configuration of the movable case 41 and the carriage 50 will be explained with reference to FIG. 3 to FIG. 9. As shown in FIG. 3 to FIG. 7, a Y direction frame 44, the first drive mechanism 45, a part of the carriage 50, a rotary drive mechanism 47 and a drive switching mechanism 48 are arranged inside the movable case 41. The Y direction frame 44 extends in the Y direction and supports the first drive mechanism 45, the carriage 50 and the rotary drive mechanism 47. The rotatable embroidery frame 9 can be attached to and removed from the carriage 50. The first drive mechanism 45 is provided with a first transport mechanism 46 and a first motor 49. The first transport mechanism 46 is provided separately from the carriage 50 and is a mechanism that transports the carriage 50 in the Y direction. The first motor 49 is provided separately from the carriage 50 and may drive the first transport mechanism 46. The drive switching mechanism 48 is a mechanism that performs switching such that transmission of the drive power from the first motor 49 to the first transport mechanism 46 is shut off, when the first drive mechanism 45 has transported the carriage 50 to a specified position in the Y direction. In the present embodiment, the specified position is a position at which the carriage 50 has moved to a front edge portion of a movable range of the carriage 50 (refer to FIG. 4). In the following explanation, the position at which the carriage 50 has moved to the front edge portion of the movable range of the carriage 50 is simply referred to as the "specified position."

The drive switching mechanism 48 is provided with a switching portion 481 and a solenoid 487. The switching portion 481 is provided with a spline shaft 482 (refer to FIG. 6 and FIG. 7) and a drive gear 483. The rotary drive mechanism 47 is a mechanism that causes the embroidery frame 9 to be rotated by the drive power of the first motor 49, in a state in which the drive switching mechanism 48 has shut off the transmission of the drive power from the first motor 49 to the first transport mechanism 46 (to be explained later).

Figure 6:
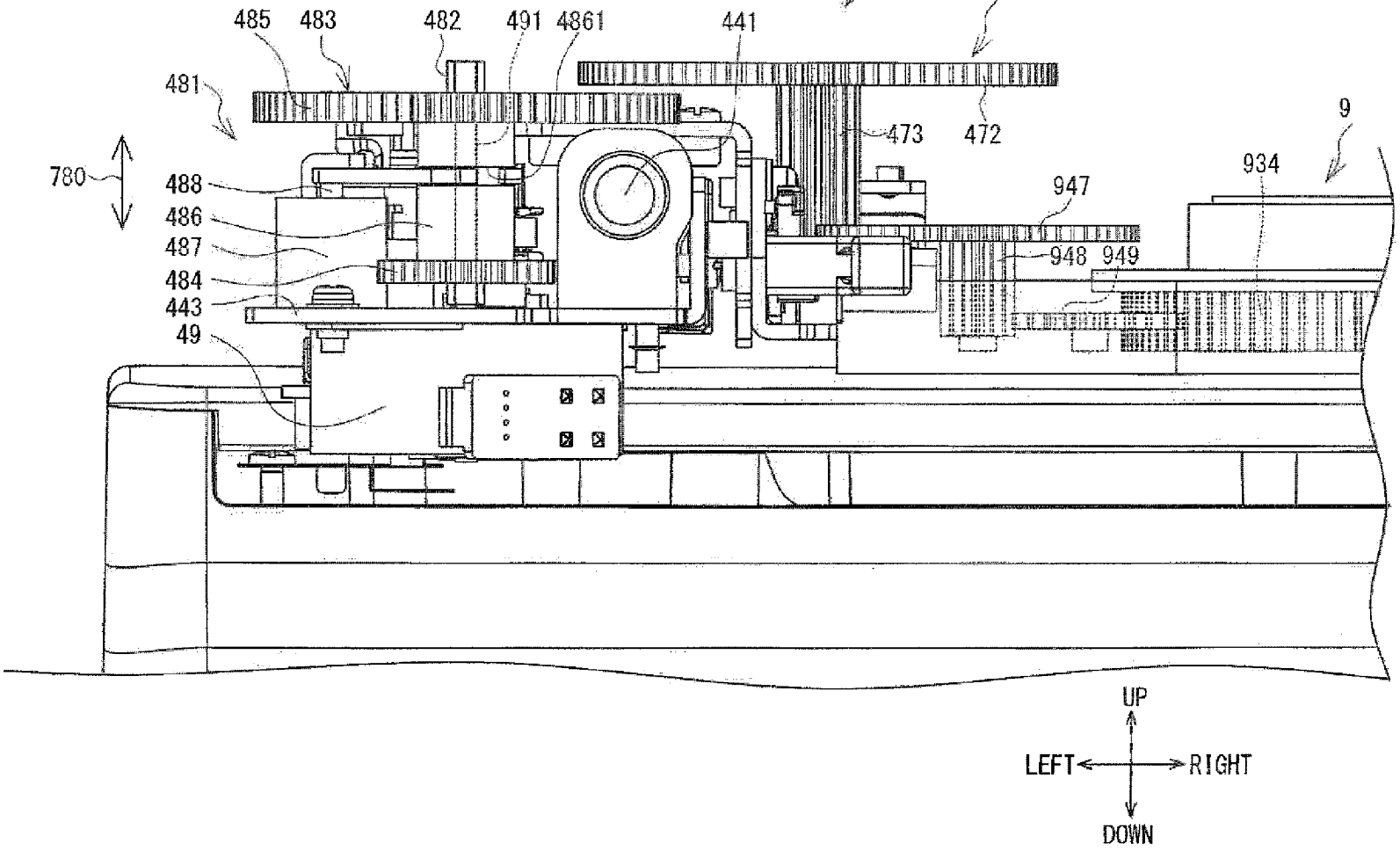
FIG. 6 is an expanded view of major portions, as seem from the front, showing the internal configuration of the movable case etc. when a drive gear is in a first position.
Figure 7:
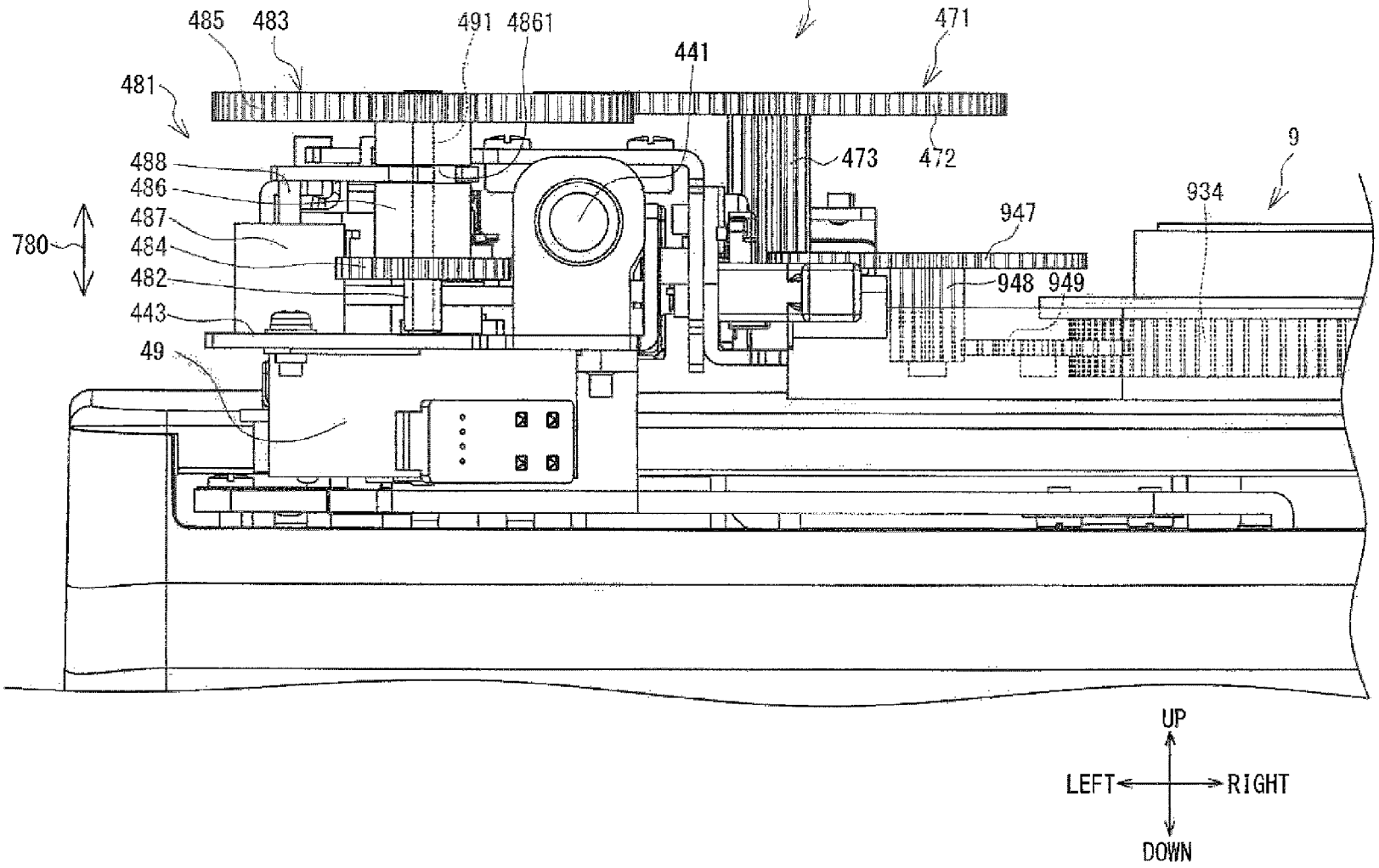
FIG. 7 is an expanded view of major portions as seen from the front, showing the internal configuration of the movable case etc. when the drive gear is in a second position.

As shown in FIG. 6 and FIG. 7, the first motor 49 is arranged on a front portion of the Y direction frame 44. A drive shaft 491 (refer to FIG. 6 and FIG. 7) of the first motor 49 extends upward and is fixed by a screw to a plate portion 443 that is supported by the Y direction frame 44. The drive shaft 491 penetrates through the plate portion 443 and extends upward. The first motor 49 is electrically connected to a drive circuit 291 (refer to FIG. 11) of a base plate 29 via wiring that is not shown in the drawings.

The spline shaft 482 has a substantially square shape in a plan view, namely, a cross-section view of the spline shaft 482 taken perpendicularly to the axial direction is substantially square-shaped. A through hole (not shown in the drawings) is formed in the center of the spline shaft 482, which fits the drive shaft 491. The spline shaft 482 is fixed to the drive shaft 491 by the drive shaft 491 being press-fitted into the through hole. The spline shaft 482 rotates in accordance with the rotation of the drive shaft 491 that is driven by the first motor 49. The drive gear 483, which rotates in accordance with the rotation of the spline shaft 482, is provided around the spline shaft 482. The drive gear 483 can move in the axial direction (refer to an arrow 780 in FIG. 6 and FIG. 7) of the spline shaft 482, due to an action of the solenoid 487 (refer to FIG. 6 and FIG. 7). The drive gear 483 has a first drive gear 484, a second drive gear 485, and a cylindrical portion 486. The cylindrical portion 486 extends in the up-down direction along the spline shaft 482. In the plan view, the shape of a hole on the inside of the cylindrical portion 486 is a substantially square shape that engages with the spline shaft 482. A groove portion 4861 is provided in a center portion, in the up-down direction, of the outer peripheral surface of the cylindrical portion 486, the groove portion 4861 being formed by the outer peripheral surface being recessed toward the inner side.

The first drive gear 484 is provided on a lower end of the cylindrical portion 486. The second drive gear 485 is provided on an upper end of the cylindrical portion 486. The diameter of the first drive gear 484 is smaller than the diameter of the second drive gear 485. The cylindrical shaped solenoid 487 is provided to the rear and the left of the first drive gear 484 such that a drive shaft 488 of the solenoid 487 is facing upward. A connecting member 489 is fixed to the upper end of the drive shaft 488. The connecting member 489 extends toward the cylindrical portion 486 of the drive gear 483 and engages with the groove portion 4861. When the drive shaft 488 moves in the up-down direction due to the driving of the solenoid 487, the drive gear 483 moves in the up-down direction via the connecting member 489.

Figure 4:
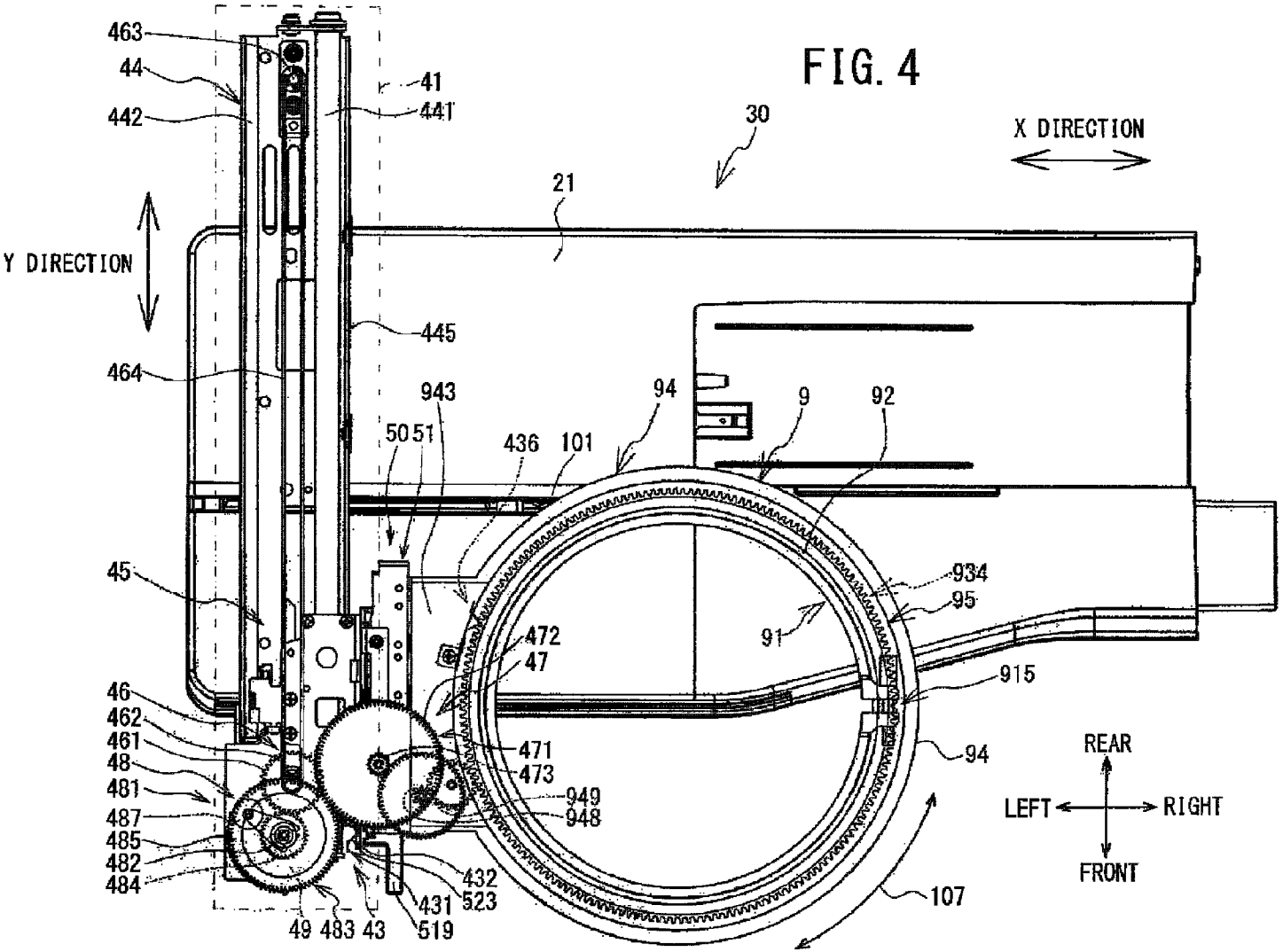
FIG. 4 is a plan view of the embroidery frame transport device showing the internal configuration of the movable case in a state in which a carriage and an embroidery frame are positioned in specific positions.
Figure 5:
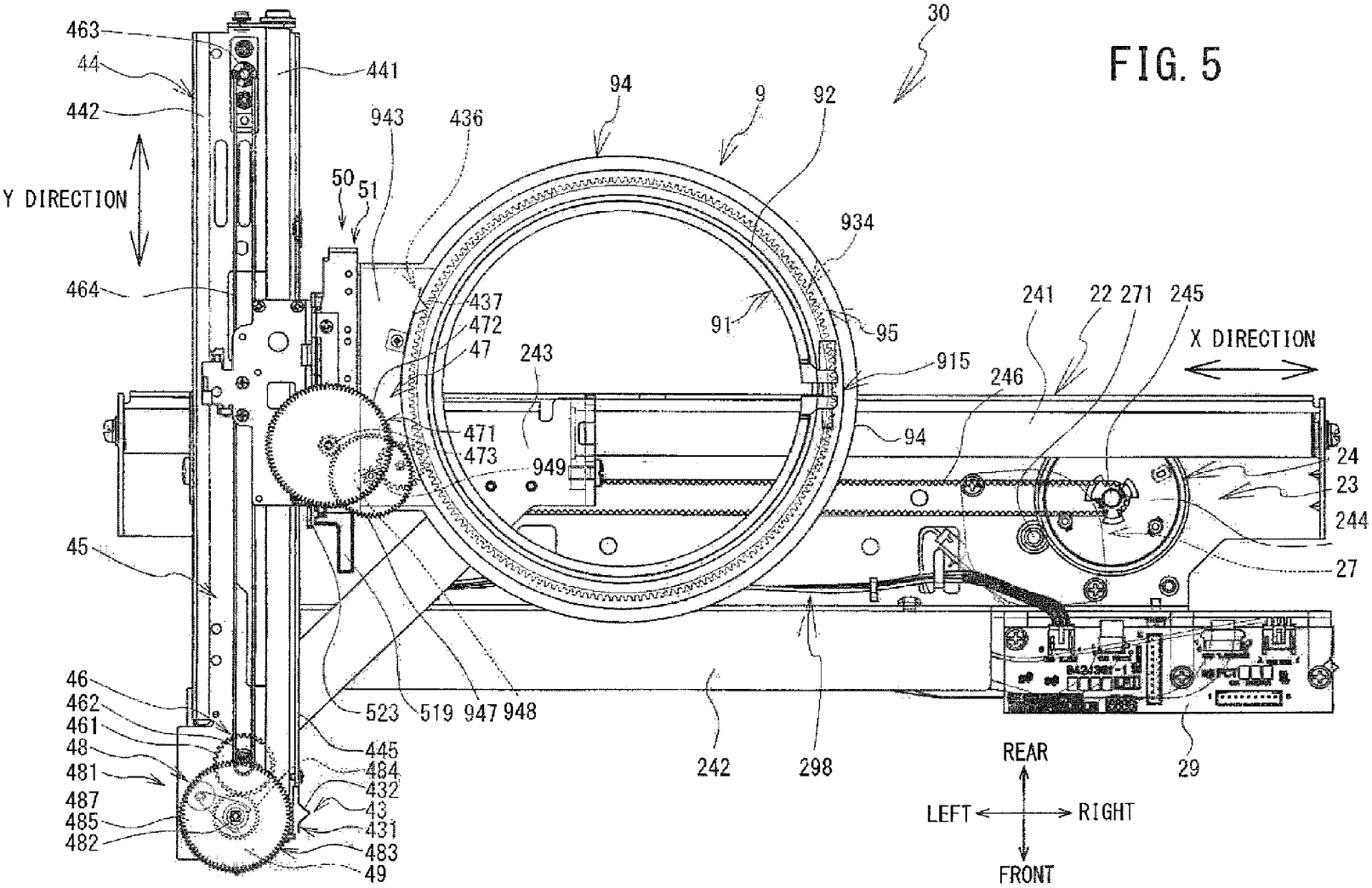
FIG. 5 is a diagram showing an internal configuration of the embroidery frame transport device.

As shown in FIG. 3 to FIG. 5, the first drive gear 484 can be coupled to the first transport mechanism 46. The first transport mechanism 46 is provided with a first driven gear 461, a first pulley 462, a second pulley 463 and a belt 464. The first driven gear 461 is arranged to the rear of the first drive gear 484 such that the first driven gear 461 can mesh with the first drive gear 484. When the drive gear 483 has moved downward (refer to FIG. 6), the first driven gear 461 meshes with the first drive gear 484. When the drive gear 483 has moved upward (refer to FIG. 7), the first driven gear 461 is separated from the first drive gear 484, and the meshing is released. In the following explanation, a position of the drive gear 483 when the drive gear 483 has been moved downward by the solenoid 487 and the drive gear 483 is meshed with the first driven gear 461 is referred to as a "first position." A position of the drive gear 483 when the drive gear 483 has been moved upward and the drive gear 483 is separated from the first driven gear 461 is referred to as a "second position."

The first pulley 462 is provided integrally with an upper side of a central portion of the first driven gear 461. The first pulley 462 rotates in accordance with the rotation of the first driven gear 461. The second pulley 463 is provided such that it is separated from the first driven gear 461 in the Y direction. The second pulley 463 is rotatably supported on the rear end portion of the Y direction frame 44. The belt 464 is stretched across the first pulley 462 and the second pulley 463. A part of the belt 464 on the right side is connected to the carriage 50.

As shown in FIG. 3 to FIG. 5, the carriage 50 supports the embroidery frame 9. A shaft 441 that extends in the front-rear direction is provided on the right end portion of the Y direction frame 44. A plate portion 442 that protrudes slightly toward the front across the front-rear direction of the Y direction frame 44 is formed on the left end portion of the Y direction frame 44. The carriage 50 can move in the front-rear direction while being supported by each of the shaft 441 and the plate portion 442.

Figure 8:
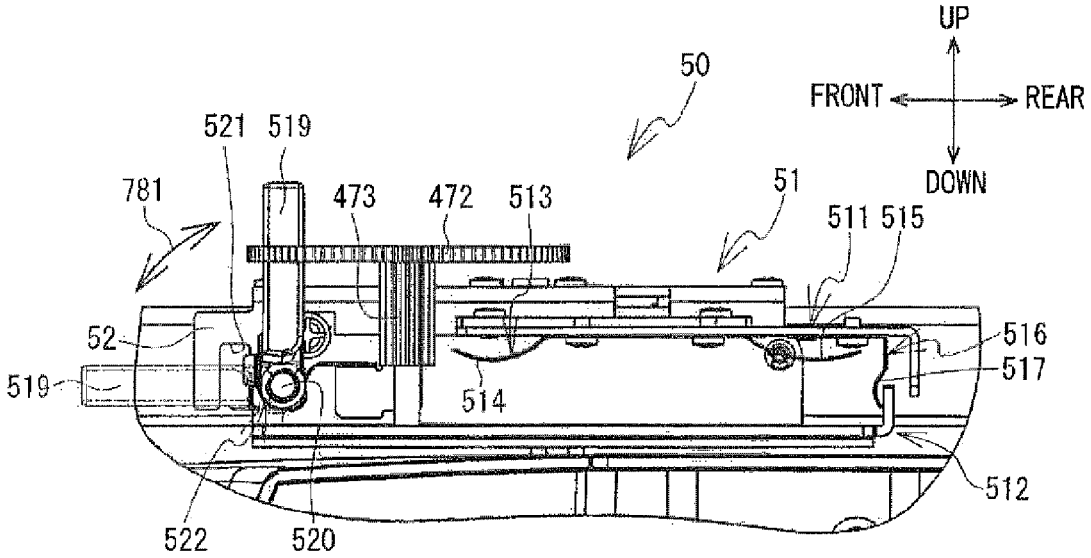
FIG. 8 is a right-side view of a support portion of the carriage.
Figure 9:
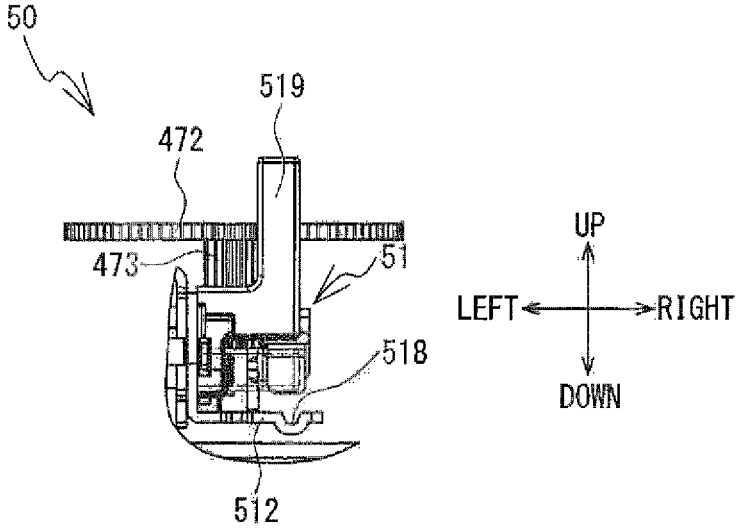
FIG. 9 is a front view of the support portion of the carriage.

A support portion 51 that supports the embroidery frame 9 is provided on the right end portion of the carriage 50. As shown in FIG. 8 and FIG. 9, the support portion 51 is provided with an upper plate portion 511, a lower plate portion 512, a plate spring 513, a plate spring 516 and a lever portion 519. The upper plate portion 511 is a plate portion that forms a wall portion on the upper side of the support portion 51 and extends in the front-rear direction. The rear end of the upper plate portion 511 is bent downward. The lower plate portion 512 is a plate portion that forms a wall portion on the lower side of the support portion 51 and extends in the front-rear direction. The rear end of the lower plate portion 512 is bent upward.

The plate spring 513 is fixed to a bottom surface of the upper plate portion 511. The plate spring 513 is provided with two pressing portions 514 and 515 that press an attachment portion 942 of the embroidery frame 9 downward. The pressing portions 514 and 515 are provided in positions separated from each other in the front-rear direction. The plate spring 516 extends downward from the rear end of the upper plate portion 511. The plate spring 516 is provided, on a lower end thereof, with a pressing portion 517 that presses the attachment portion 942 of the embroidery frame 9 toward the front.

A recessed portion 518 that is recessed downward across the front-rear direction is provided in the right end portion of the lower plate portion 512 (refer to FIG. 9). The lever portion 519 is provided on the front end portion of the support portion 51. A base end of the lever portion 519 is supported by a shaft strut 520. The leading end of the lever portion 519 can oscillate between an upward-facing stance and a forward-facing stance (refer to an arrow 781 in FIG. 8). When the leading end of the lever portion 519 is in the upward-facing stance, an opening 522 between the lever portion 519 and the lower plate portion 512 is in an open state. When the lever portion 519 is in the forward-facing stance, the opening 522 is closed by the lever portion 519. A method of attaching the embroidery frame 9 to the support portion 51 will be explained later.

As shown in FIG. 3 to FIG. 7, the rotary drive mechanism 47 is provided with a second driven gear 471. The second driven gear 471 is provided on the carriage 50. The second driven gear 471 has an upper gear 472 and a lower gear 473. The lower gear 473 is provided below the upper gear 472. When the carriage 50 is positioned in the specified position and the drive gear 483 is positioned in the second position (refer to FIG. 7), the upper gear 472 and the second drive gear 485 of the drive gear 483 mesh with each other. When the carriage 50 has move further to the rear than the specified position, or when the drive gear 483 has moved to the first position, the meshing between the upper gear 472 and the second drive gear 485 of the drive gear 483 is released. When the embroidery frame 9 is mounted on the carriage 50, the lower gear 473 meshes with a gear 947 provided on the embroidery frame 9. When the second driven gear 471 rotates, the embroidery frame 9 also rotates and this will be explained in more detail later.

A regulation portion 43 will be explained. The regulation portion 43 regulates the movement of the carriage 50 in the Y direction when the embroidery frame 9 is rotated by the rotary drive mechanism 47 and regulates the rotation of the embroidery frame 9 when the carriage 50 is moved in the Y direction by the first transport mechanism 46. The regulation portion 43 includes plate springs 431 and 436. The plate spring 431 is provided on the front end portion of a wall portion 445 of the right side of the Y direction frame 44 such that it extends toward the front. A base end of the plate spring 431 is fixed to the front end portion of the wall portion 445. A protruding portion 432, which is formed in a substantially V shape such that it protrudes toward the right is provided on the leading end of the free end portion of the plate spring 431. An engagement plate 52 is provided on the front end portion on the left side of the support portion 51 of the carriage 50 such that the engagement plate 52 extends toward the front. A cut out portion 521 is cut out toward the upward direction from the lower end of the engagement plate 52 (refer to FIG. 8). When the carriage 50 moves to a front end position (the specified position), the protruding portion 432 engages with the cut out portion 521. At that time, the carriage 50 is locked in place by the elastic force of the plate spring 431 and the movement of the carriage 50 in the Y direction is regulated. On the other hand, by the carriage 50 resisting the elastic force of the plate spring 431 and moving from the front end position (the specified position) toward the rear, the engagement of the protruding portion 432 and the cut out portion 521 is released. The plate spring 436 is provided on the embroidery frame 9, and this will be explained in more detail later.

Figure 10:
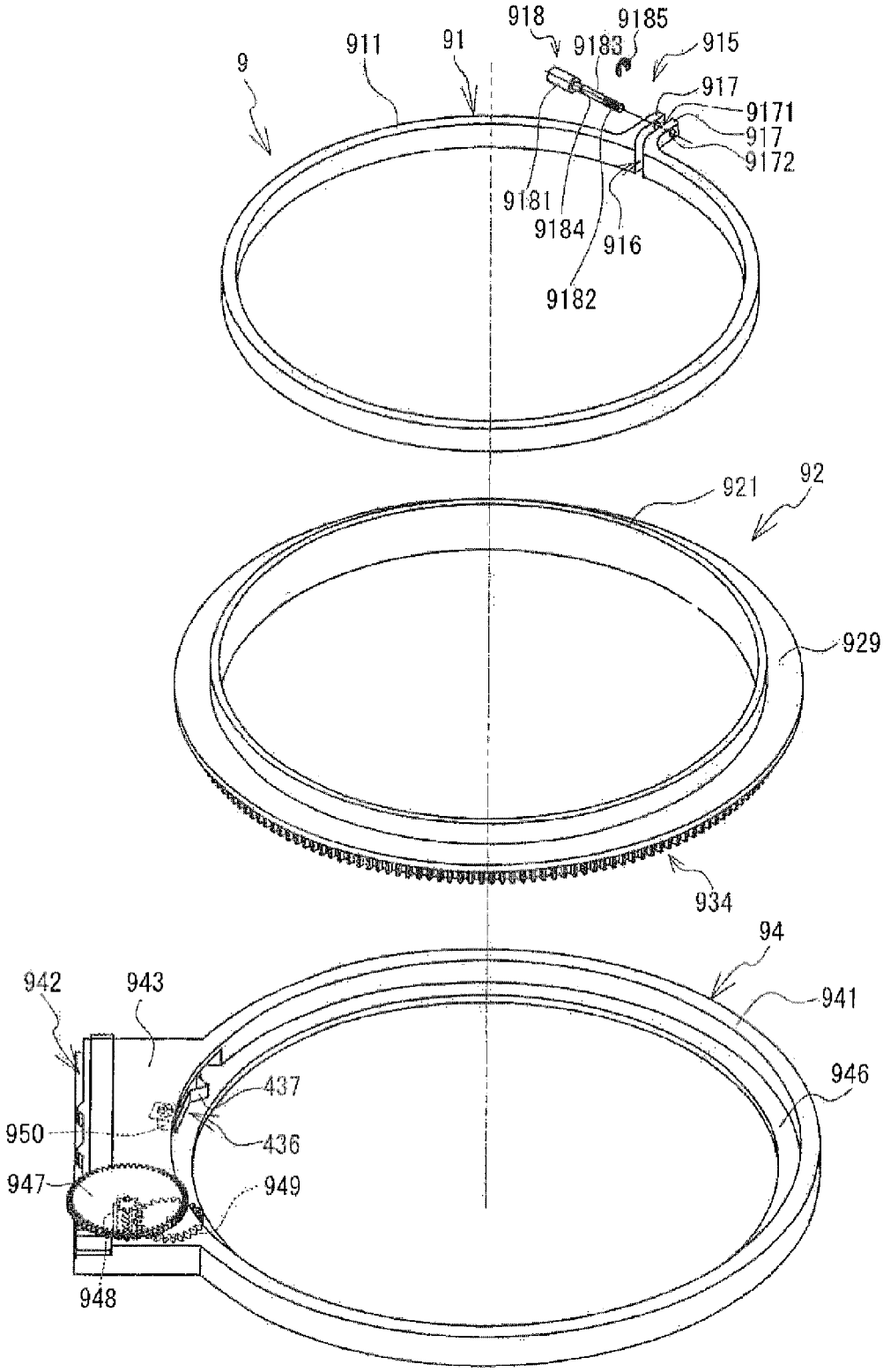
FIG. 10 is an exploded perspective view of the embroidery frame.

The embroidery frame 9 will be explained. In the following explanation, the up-down direction in FIG. 10 is the up-down direction of the embroidery frame 9. As shown in FIG. 3 and FIG. 10, the embroidery frame 9 is formed of a combination of an inner frame 91, a middle frame 92 and an outer frame 94 that each have a circular frame shape. In the embroidery frame 9, the middle frame 92 is arranged on the outer side, in the radial direction, of the inner frame 91. The outer frame 94 is arranged on the outer side, in the radial direction, of the middle frame 92. The embroidery frame 9 clamps the work cloth 100 between the inner frame 91 and the middle frame 92 (refer to FIG. 1). The embroidery frame 9 has a configuration such that the middle frame 92 can rotate with respect to the outer frame 94.

The inner frame 91 is provided with a circular frame portion 911. The frame portion 911 has thickness in the axial direction. The inner frame 91 is provided with an adjustment portion 915 that can adjust the diameter of the inner frame 91. The diameter of the inner frame 91 is adjusted depending on a cloth thickness of the work cloth 100 that is clamped between the inner frame 91 and the middle frame 92. The adjustment portion 915 is provided with a parting portion 916, a pair of screw mounting portions 917 and an adjusting screw 918. The parting portion 916 is a portion at which a part of the frame portion 911 of the inner frame 91, in the circumferential direction, is discontinuous through the axial direction. The pair of screw mounting portions 917 are provided on an upper portion on both sides of the split portion 916 on the frame portion 911, and protrude on the outer side in the radial direction such that they face each other. Hole portions 9171 and 9172 are provided in the pair of screw mounting portions 917, and the hole portions 9171 and 9172 penetrate in a direction that is orthogonal to a facing surface of the screw attachment portions 917. Of the two hole portions 9171 and 9172, a nut (not shown in the drawings), in which a screw hole is formed, is embedded in the one hole portion 9172 (the hole portion on the lower right side in FIG. 10).

The adjusting screw 918 is a screw member that is provided with a large diameter head portion 9181 and a small diameter shaft portion 9183. A user can grip the head portion 9181 with his or her fmgers and cause it to rotate. The shaft portion 9183 is a portion that extends integrally from the head portion 9181. A male screw portion 9182 is formed around a portion toward the leading end of the shaft portion 9183. A fine groove 9184, into which a retaining ring 9185 is fitted, is formed on a portion of the shaft portion 9183 toward the side of the head portion 9181. The adjusting screw 918 is mounted such that the shaft portion 9183 penetrates through the hole portion 9171 and the male screw portion 9182 is screwed into the nut embedded in the hole portion 9172. In this state, by the retaining ring 9185 being fitted into the fine groove 9184 of the shaft portion 9183, the adjusting screw 918 is held such that it can rotate around the screw mounting portion 917 on the side of the hole portion 9171 and, at the same time, is not able to move in the axial direction. When the user grips the head portion 9181 of the adjusting screw 918 and performs a rotating operation, the screw mounting portion 917 on the side of the hole portion 9172 moves in the axial direction of the shaft portion 9183, via the nut. The movement direction of the adjusting screw 918 is determined by the direction of rotation of the adjusting screw 918. In this manner, in addition to connecting the pair of screw mounting portions 917, the adjusting screw 918 is able to adjust a gap between the pair of screw mounting portions 917 such that it increases or decreases. By adjusting the gap between the pair of screw mounting portions 917, the diameter of the inner frame 91 is adjusted in accordance with the cloth thickness of the work cloth 100. For example, the narrower the gap between the pair of screw mounting portions 917, the smaller the diameter of the inner frame 91 becomes, and the work cloth 100 having a thicker cloth thickness can be clamped between the middle frame 92 and the inner frame 91. It should be noted that the retaining ring 9185 is omitted from the drawings apart from FIG. 10.

The middle frame 92 is provided with a circular frame portion 921 that has a larger inner diameter than the outer diameter of the frame portion 911 of the inner frame 91. The middle frame 92 is attached to and removed from the inner frame 91 by attaching or removing the frame portion 921 of the middle frame 92 to and from the outside of the frame portion 911 of the inner frame 91 in the radial direction. A frame gear 934, which is a cog formed around the whole circumference of the outer periphery surface, is formed on the he lower end portion of the frame portion 921 of the middle frame 92. The frame gear 934 meshes with a gear 949 provided on the carriage 50. A flange portion 929 is provided in a central portion, in the axial direction, of the outer peripheral side surface of the frame portion 921 and on the upper side of the frame gear 934. The flange 929 protrudes toward the outside, in the radial direction, around the whole circumference of the frame portion 921.

The outer frame 94 is provided with a circular frame portion 941. A support portion 946 is provided on the inner peripheral side surface at the lower edge of the frame portion 941. The support portion 946 protrudes toward the inside, in the radial direction, and is provided around the whole circumference of the frame portion 941. The frame portion 941 holds the middle frame 92 by the support portion 946 supporting the lower edge surface of the middle frame 92.

The attachment portion 942 is provided on the outside, in the radial direction, of the frame portion 941. The attachment portion 942 is formed such that it can be attached to and removed from the carriage 50. A convex portion 951 (refer to FIG. 13) is provided on the bottom surface of the attachment portion 942 such that the convex portion 951 protrudes downward. The convex portion 951 extends in the front-rear direction in a state in which the embroidery frame 9 is mounted on the carriage 50. When the embroidery frame 9 is mounted on the carriage 50, the convex portion 951 fits into the recessed portion 518 of the carriage 50.

A box-shaped housing portion 943, which couples the frame portion 941 and the attachment portion 942, is provided between the frame portion 941 and the attachment portion 942. As shown in FIG. 3 and FIG. 10, the gear 947 is provided above the housing portion 943. The gear 947 is formed integrally with a gear 948 that is provided below the gear 947. The gear 948 has a smaller diameter than the gear 947. The gear 948 extends into the interior of the housing portion 943 via a hole that is not shown in the drawings and that is provided on the upper surface of the housing portion 943. When the embroidery frame 9 is mounted on the carriage 50, the gear 947 meshes with the lower gear 473 of the second driven gear 471. The gear 948 meshes with the gear 949 that is housed inside the housing portion 943. The end of the gear 949 on the frame portion 941 side is exposed on the inside of the frame portion 941 from a hole that is not shown in the drawings and that is provided in the frame portion 941. The gear 949 can mesh with the frame gear 934.

The plate spring 436 that functions as the regulation portion 43, in a state in which the embroidery frame 9 is mounted on the carriage 50, is provided on the rear right portion of the housing portion 943. As shown in FIG. 10, the base end of the plate spring 436 is fixed by a screw to a cylindrically shaped screw attachment portion 950. A protruding portion 437 is formed on the leading end of the free end portion that extends from the base portion of the plate spring 436. The protruding portion 437 is formed in a substantially V shape and protrudes toward the middle frame 92. Although not shown in detail in the drawings, the leading end of the protruding portion 437 can engage with adjacent teeth among the teeth of the frame gear 934. When the leading end of the protruding portion 437 is positioned between two adjacent teeth, the frame gear 934 is locked in place such that it does not rotate, due to the elastic force of the plate spring 436.

When the frame gear 934 rotates, the frame gear 934 resists the elastic force of the plate spring 436 and rotates. Thus, the elastic force of the plate spring 436 is set to be an elastic force to a degree at which the frame gear 934 can rotate due to the rotary drive force transmitted from the gear 949 and also at which the rotation of the frame gear 934 is locked when the rotary drive force from the gear 949 is not transmitted.

The internal configuration of the case 21 will be explained in detail with reference to FIG. 5. An X direction frame 22, a second drive mechanism 23 and the base plate 29 etc. are arranged inside the case 21. The X direction frame 22 has a specific width toward the front from a central portion, in the front-rear direction, inside the case 21, and extends in the left-right direction (the X direction). The X direction frame 22 supports the second drive mechanism 23 and the base plate 29.

The second drive mechanism 23 is a mechanism to transport the first drive mechanism 45 in the X direction by transporting the Y direction frame 44 in the X direction. More specifically, the second drive mechanism 23 is provided with a second transport mechanism 24 and a second motor 27. The second transport mechanism 24 is a mechanism to transport the first transport mechanism 46 in the X direction. The second motor 27 drives the second transport mechanism 24.

The second transport mechanism 24 includes a guide shaft 241, a guide member 242, an auxiliary frame 243, a large diameter gear 244, a pulley 245 and a timing belt 246. The guide shaft 241 is provided on a rear portion of the X direction frame 22 and is long in the left-right direction. Both end portions of the guide shaft 241 are fixed both sides on the left and the right of wall portions of the X direction frame 22. The guide member 242 is connected to a wall portion of the front end of the X direction frame 22. The guide member 242 has a specific width in the front-rear direction and extends in the left-right direction.

The auxiliary frame 243 is disposed above the guide shaft 241 and the guide member 242. The auxiliary frame 243 is a substantially triangular-shaped frame that has a portion extending in the left-right direction along the guide shaft 241 and a portion extending diagonally to the left and to the front from the right end of the portion extending along the guide shaft 241. The auxiliary frame 243 is supported by the guide shaft 241 and the guide member 242 and such that it can slide in the left-right direction. The rear end portion of the auxiliary frame 243 is formed such that it extends upward. The rear end portion of the auxiliary frame 243 protrudes upward from the slit 101 (refer to FIG. 1) and is connected to the Y direction frame 44. The front end portion of the auxiliary frame 243 is formed such that, after protruding to the front from the slit 102 (refer to FIG. 1), it extends upward and is connected to the Y direction frame 44.

The second motor 27 is fixed below the bottom of the front right portion of the X direction frame 22 such that the second motor 27 faces upward. The second motor 27 has a drive shaft (not shown in the drawings) that is inserted through the bottom portion of the X direction frame 22 to the upper side. A drive gear 271 is affixed to the upper end of the drive shaft. The large diameter gear 244 and the pulley 245, which are integrally formed, are rotatably supported on a right portion of the X direction frame 22. The large diameter gear 244 meshes with the drive gear 271. A pulley that is not shown in the drawings is rotatably supported on a left portion of the X direction frame 22. The endless timing belt 246 is stretched over the pulley positioned on the left portion of the X direction frame 22 and over the pulley 245. The timing belt 246 is disposed between the guide shaft 241 and the guide member 242. A part of the timing belt 246 is coupled to the auxiliary frame 243. When the timing belt 246 moves, the auxiliary frame 243 is transported in the X direction and the Y direction frame 44 is transported in the X direction.

The base plate 29 is connected to the front right portion of the X direction frame 22. The drive circuit 291, a drive circuit 292, a drive circuit 293 (refer to FIG. 11) and a connector etc. (not shown in the drawings) are mounted on the base plate 29. A wiring group 298 that extends from the base plate 29 is disposed such that it is inserted through the slit 101 toward the Y direction frame 44. The wiring group 298 includes wiring that electrically connects the drive circuit 291 and the first motor 49, and wiring that electrically connects the drive circuit 293 and the solenoid 487.

Figure 11:
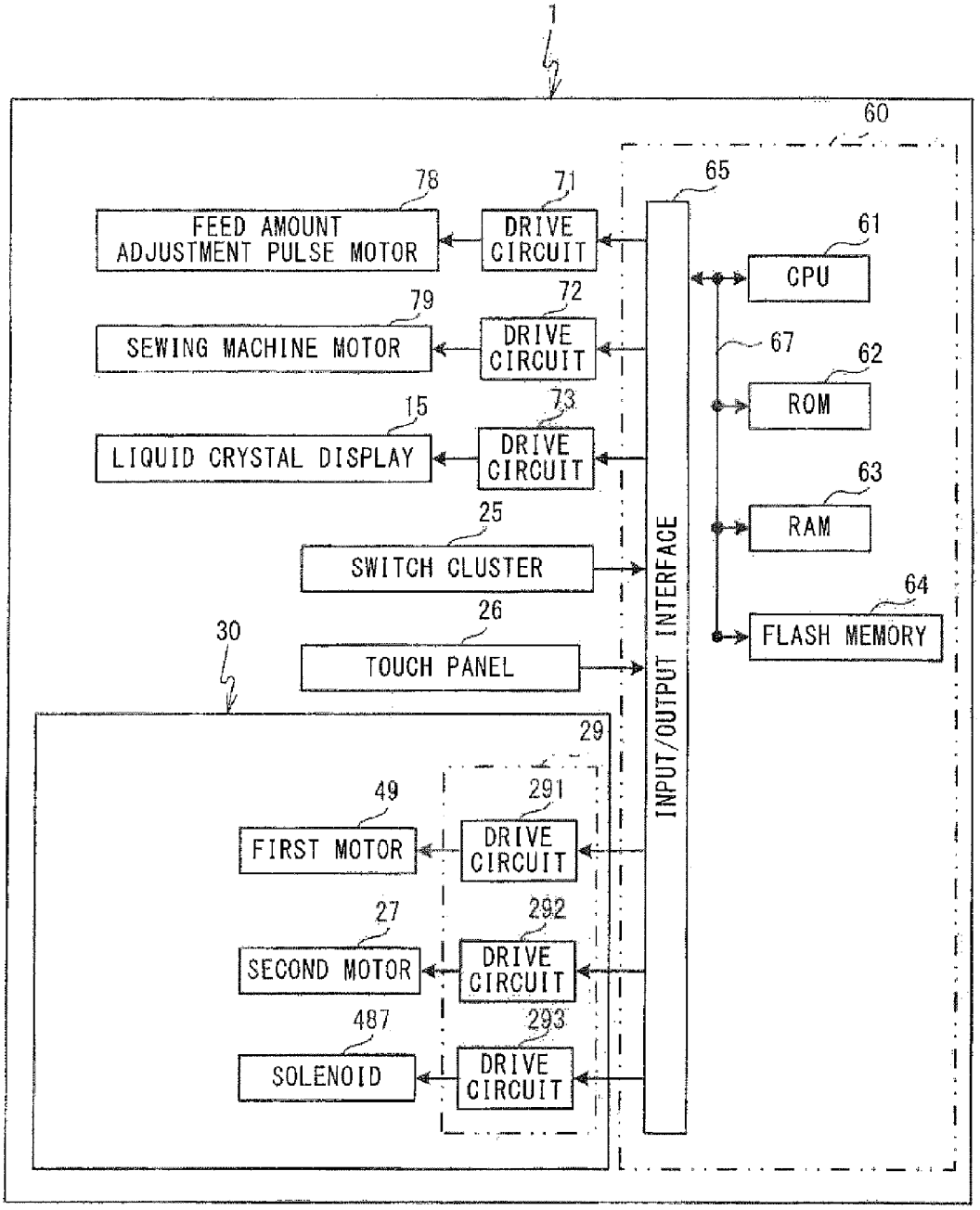
FIG. 11 is a block diagram showing an electrical configuration of the sewing machine.

The electrical configuration of the sewing machine 1 will be explained with reference to FIG. 11. As shown in FIG. 11, a control portion 60 of the sewing machine 1 is provided with a CPU 61, a ROM 62, a RAM 63, a flash memory 64 and an input/output interface 65, which are mutually connected via a bus 67. Program data etc. used for the CPU 61 to perform processing are stored in the ROM 62. A plurality of embroidery data and cut work data etc. that will be explained later, which are used for the sewing machine 1 to perform embroidery sewing, and various data are stored in the flash memory 64.

The switch cluster 25, the touch panel 26, drive circuits 71 to 73 and the drive circuits 291 to 293 are electrically connected to the input-output interface 65. The drive circuit 71 may drive the feed amount adjustment pulse motor 78. The drive circuit 72 may drive the sewing machine motor 79. The drive circuit 73 may drive the liquid crystal display 15. The drive circuits 291 to 293 are mounted on the base plate 29 of the embroidery frame transport device 30. When the embroidery frame transport device 30 is connected to a main body of the sewing machine 1, the drive circuits 291 to 293 are connected to the input-output interface 65 via connectors that are not shown in the drawings. The drive circuit 291 may drive the first motor 49. The drive circuit 292 may drive the second motor 27. The drive circuit 293 may drive the solenoid 487.

An operation will be explained in which the carriage 50 is transported and the embroidery frame 9 is rotated while the work cloth 100 is clamped by the embroidery frame 9. The user places the middle frame 92 on a work table (not shown in the drawings) such that the frame gear 934 is on the lower side. The user presses the work cloth 100 downward using the lower edge of the inner frame 91 and inserts the inner frame 91 into the inside of the middle frame 92. The embroidery frame 9 clamps the work cloth 100 between the inner frame 91 and the middle frame 92 (refer to FIG. 1). At this time, the user adjusts the diameter of the inner frame 91 depending on the cloth thickness of the work cloth 100 by appropriately rotating the adjusting screw 918. In the state in which the work cloth 100 is clamped, the surface of the work cloth 100 on which the sewing is performed is in a state of being stretched on the inside of the inner frame 91 on the lower edge of the inner frame 91. In the following explanation, the frame of the state in which the inner frame 91 and the middle frame 92 are assembled together is referred to as an assembled unit 95 (refer to FIG. 1 and FIG. 3). Note that, apart from FIG. 1, the work cloth 100 is not shown in the drawings.

Next, the user sets the assembled unit 95 in the outer frame 94 from above the outer frame 94. The user places the assembled unit 95 in the outer frame 94 such that the frame gear 934 and the gear 949 mesh together. The protruding portion 437 of the plate spring 436 engages with the teeth of the frame gear 934 and regulates the rotation of the middle frame 92 (the assembled unit 95) with respect to the outer frame 94. The inner frame 91, the middle frame 92 and the outer frame 94 are assembled in this manner, and the completed embroidery frame 9 is obtained.

Figure 12:
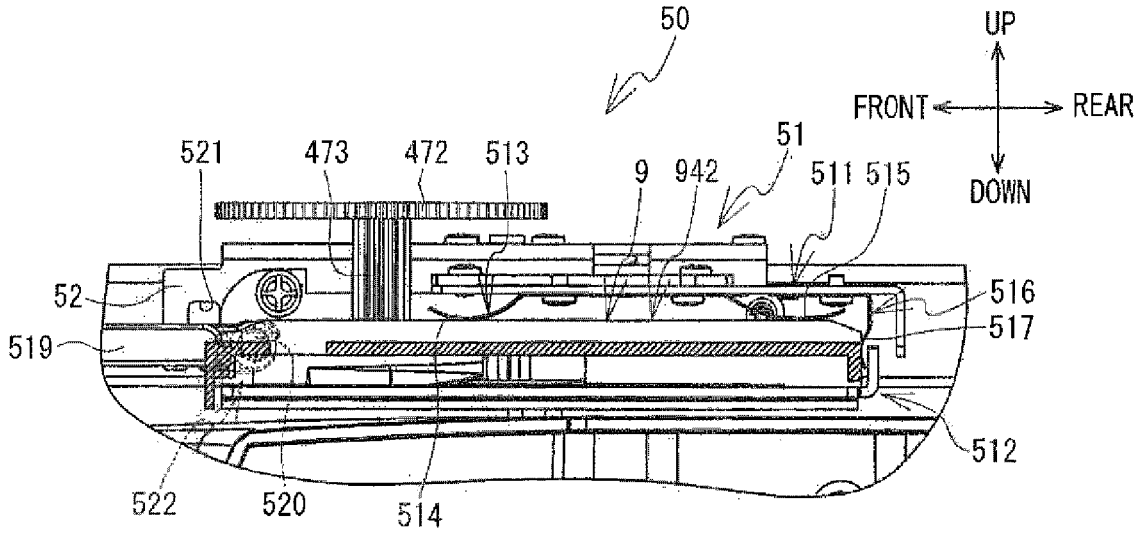
FIG. 12 is a right-side view of the carriage on which the embroidery frame is mounted.
Figure 13:
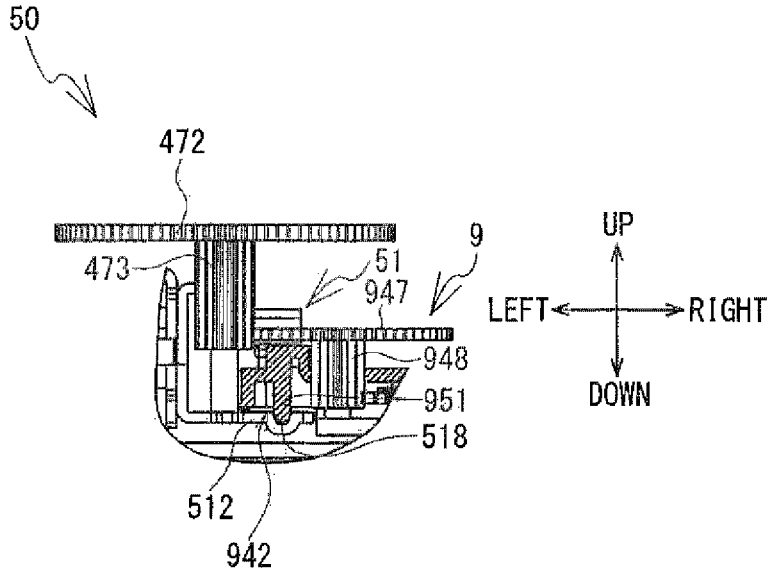
FIG. 13 is a cross-section view of the support portion in a state in which the embroidery frame is mounted thereon.

Next, the embroidery frame 9 is mounted on the carriage 50. As shown in FIG. 8, the user orients the leading end of the lever portion 519 upward. The user inserts the attachment portion 942 into the support portion 51 such that the attachment portion 942 of the embroidery frame 9 slides, from the opening 522 (refer to FIG. 8) of the support portion 51 toward the rear. At that time, as shown in FIG. 13, the user slides the attachment portion 942 of the embroidery frame 9 such that the concave portion 951 of the attachment portion 942 moves along the convex portion 518. As shown in FIG. 12, after the user has inserted the attachment portion 942 into the support portion 51, the user rotates the lever portion 519 and orients the leading end of the lever portion 519 toward the front. The attachment portion 942 is pressed downward by the pressing portions 514 and 515 of the plate spring 513, and the attachment portion 942 is clamped between the pressing portions 514 and 515 and the lower plate portion 512. The attachment portion 942 is pressed toward the front by the pressing portion 517 of the plate spring 516 and is clamped between the pressing portion 517 and the lever portion 519. The embroidery frame 9 is fixed to the carriage 50 in this manner.

The blade 89 of the cut work needle 8 has the specific width in the front-rear direction (refer to FIG. 2). For that reason, the direction of the cut formed in the work cloth 100 by the cut work needle 8 is the front-rear direction. Thus, in order to cut out a specified pattern in the work cloth 100 along a pattern-shaped contour, as well as moving the embroidery frame 9 in the X direction and the Y direction, it is necessary to rotate the embroidery frame 9 and change the direction of the cuts formed in the work cloth 100. Cut work data that is used to create a specified pattern etc. by the sewing machine 1 cutting the work cloth 100 is stored in the flash memory 64 of the sewing machine 1. In the cut work data, data of a variable N, frame rotation data, X coordinates and Y coordinates are associated with each other. The variable N is a variable that indicates an order of cutting the work cloth 100. The frame rotation data is data of a rotation angle of the embroidery frame 9 that is set in advance. The X coordinates and the Y coordinates are coordinates of needle drop points (points at which the cut work needle 8 pierces the work cloth 100) in an embroidery coordinate system that is unique to the sewing machine 1 and that is set in advance. The CPU 61 of the sewing machine 1 controls the embroidery frame transport device 30, rotates the embroidery frame 9 by the rotation angle represented by the frame rotation data in the order of the variable N of the cut work data, and moves the embroidery frame 9 to the coordinates (X coordinates and Y coordinates) of the respective needle drop points. The CPU 61 drives the sewing machine motor 79 and thus drives the needle bar 6 (refer to FIG. 2), and forms the cuts by the cut work needle 8 (refer to FIG. 2) in the work cloth 100.

The X coordinate and the Y coordinate of a current needle drop point, and a current rotation angle of the embroidery frame 9 are stored in the RAM 63. The CPU 61 determines a rotation amount of the first motor 49 in order to rotate the embroidery frame 9 by a difference between the current rotation angle of the embroidery frame 9 and a next rotation angle. The CPU 61 determines a rotation amount of the first motor 49 in order to transport the embroidery frame 9 to the specified position (refer to FIG. 4) from the Y coordinate of the current needle drop point. The CPU 61 determines a rotation amount of the first motor 49 in order to transport the embroidery frame 9 from the Y coordinate of a next needle drop point from the specified position. The CPU 61 determines a rotation amount of the second motor 27 such that the Y direction frame 44 that supports the carriage 50 is transported by the difference between the X coordinate of the current needle drop point and the X coordinate of the next needle drop point. In the following explanation, the rotation amounts of the first motor 49 and the second motor 27 determined by the CPU 61 are collectively referred to as a "determined rotation amount."

An operation of the embroidery frame transport device 30 when the carriage 50 and the embroidery frame 9 are transported in the Y direction will be explained. The transport of the carriage 50 and the embroidery frame 9 in the Y direction is performed according to control by the CPU 61.

A case will be explained in which the embroidery frame 9 is transported from a position that is further to the rear than the specified position (refer to FIG. 3) to the specified position (refer to FIG. 4). The solenoid 487 is driven and the drive gear 483 is moved to the first position (refer to FIG. 6). In this manner, the first drive gear 484 is in a state of being meshed with the first driven gear 461. At that time, the second drive gear 485 does not mesh with the second driven gear 471. Thus, even if the drive gear 483 rotates, the embroidery frame 9 is in a rotation cessation state in which the embroidery frame 9 does not rotate.

The first motor 49 is driven and the drive gear 483 is rotated. In accordance with the rotation of the drive gear 483, the first driven gear 461 and the first pulley 462 rotate. The belt 464 is transported while the first pulley 462 and the second pulley 463 are rotating. In this way, the carriage 50 that is connected to the belt 464 is transported toward the front, and the embroidery frame 9 is transported toward the front. The CPU 61 causes the first motor 49 to rotate by the determined rotation amount, and then stops the first motor 49. In this way, the embroidery frame 9 is transported to the specified position (refer to FIG. 4). Note that the rotation of the frame gear 934 of the embroidery frame 9 is regulated by the plate spring 436. As a result, when the carriage 50 and the embroidery frame 9 are transported in the Y direction, the embroidery frame 9 is inhibited from rotating arbitrarily. When the embroidery frame 9 is moved to the specified position, the plate spring 431 engages with the cut out portion 521 (refer to FIG. 8). Thus, the movement of the carriage 50 and the embroidery frame 9 is regulated in the Y direction.

An operation of the embroidery frame transport device 30 when the embroidery frame 9 is rotated will be explained. The rotation of the embroidery frame 9 is performed in accordance with control by the CPU 61. The solenoid 487 is driven and the drive gear 483 is transported to the second position (refer to FIG. 7). In this way, the second drive gear 485 is in a state of being meshed with the upper side gear 472 of the second driven gear 471. At that time, the first drive gear 484 does not mesh with the first driven gear 461. In other words, when the first drive mechanism 45 has transported the carriage 50 to the specified position, the drive switching mechanism 48 performs switching such that the transmission of the drive power from the first motor 49 to the first transport mechanism 46 is shut off. As a result, even if the drive gear 483 rotates, the carriage 50 and the embroidery frame 9 are in a transport cessation state and are not transported in the Y direction.

The first motor 49 is driven and the drive gear 483 is rotated. In accordance with the rotation of the drive gear 483, the frame gear 934 rotates, via the upper side gear 472, the lower side gear 473, the gear 947, the gear 948 and the gear 949. The embroidery frame 9 (more specifically, the assembled unit 95) rotates in this manner (refer to an arrow 107 in FIG. 4). Specifically, in the state in which the transmission of the drive power from the first motor 49 to the first transport mechanism 46 is shut off by the drive switching mechanism 48, the rotary drive mechanism 47 causes the embroidery frame 9 to rotate due to the drive power of the first motor 49. The CPU 61 causes the first motor 49 to rotate by the determined rotation amount and then stops the first motor 49. The next rotation angle is set for the embroidery frame 9 in this manner.

The movement of the carriage 50 and the embroidery frame 9 in the Y direction is regulated by the plate spring 431. As a result, when the drive gear 483 causes the second driven gear 471 to rotate, the second driven gear 471 is inhibited from being displaced from the specified position. More specifically, the second driven gear 471 is inhibited from separating from the drive gear 483 arbitrarily. Thus, the embroidery frame 9 can be caused to reliably rotate.

After the embroidery frame 9 has been rotated to the specified position, the embroidery frame 9 is transported to the Y coordinate of the next needle drop point. The method of transport is the same as the case in which the embroidery frame 9 is transported to the specified position (refer to FIG. 4) as described above. Note, however, that the first motor 49 rotates in the opposite direction to the case in which the embroidery frame 9 is transported toward the front.

An operation of the embroidery frame transport device 30 when the embroidery frame 9 is transported in the X direction will be explained. The transport of the carriage 50 and the embroidery frame 9 in the X direction is performed in accordance with control by the CPU 61. The second motor 27 is driven and the drive gear 271 is driven. The large diameter gear 244 and the pulley 245 rotate in accordance with the rotation of the drive gear 271. The timing belt 246 moves in accordance with the rotation of the pulley 245. The auxiliary frame 243 is transported in the X direction along the guide shaft 241 and the guide member 242 in accordance with the movement of the timing belt 246. In this manner, the Y direction frame 44 that is connected to the auxiliary frame 243 is transported in the X direction, and the embroidery frame 9 is transported in the X direction. The CPU 61 rotates the second motor 27 by the determined rotation amount and then stops the second motor 27. The rotation of the frame gear 934 of the embroidery frame 9 is regulated by the plate spring 436. Thus, the embroidery frame 9 is inhibited from rotating arbitrarily when the carriage 50 and the embroidery frame 9 are transported in the X direction.

The transport and the rotation of the embroidery frame 9 of the present embodiment are performed as described above. In the present embodiment, the first motor 49 is not provided on the carriage 50. Thus, in comparison to a case in which a motor is provided on the carriage 50, the weight of the carriage 50 can be reduced. As a result, when the first drive mechanism 45 transports the carriage 50 in the Y direction, it becomes easier for the carriage 50 to stop. Thus, it is possible to improve the accuracy of the stop position of the embroidery frame 9 and the carriage 50.

The transport of the carriage 50 in the Y direction and the rotation of the embroidery frame 9 are performed by the first motor 49. Therefore, in comparison to a case in which two motors are used to drive the first transport mechanism 46 and the rotary drive mechanism 47, the number of motors can be decreased and costs can be reduced.

In comparison to a case in which the carriage 50 is provided with a motor, as well as reducing the weight of the carriage 50, it is possible to downsize the carriage 50. As a result, the carriage 50 is less likely to deform. It is thus possible to inhibit any impact on the sewing or the cut work as a result of deformation of the carriage 50. Further, as a motor is not provided on the embroidery frame 9, it is possible to reduce the costs of the embroidery frame 9 itself.

The solenoid 487 can switch between the first position and the second position by moving the drive gear 483 in the axial direction of the spline shaft 482. The embroidery frame transport device 30 can transport the carriage 50 and the embroidery frame 9 in the Y direction by driving the first motor 49, the spline shaft 482, the drive gear 483, the first driven gear 461, the first pulley 462, the second pulley 463 and the belt 464.

In the present embodiment, the solenoid 487 drives the switching portion 481 and it is possible to cut off the transmission of the drive power to the first transport mechanism 46 and perform the transmission of the drive power to the rotary drive mechanism 47. In addition, it is possible to switch between the transport of the carriage 50 and the embroidery frame 9 in the Y direction and the rotation of the embroidery frame 9 by the single solenoid 487 causing the single drive gear 483 to move between the first position and the second position. As a result, it is possible to reduce costs in comparison to a case in which a plurality of actuators, such as solenoids are provided and a plurality of drive gears are provided such it is possible to switch between the transport of the carriage 50 and the embroidery frame 9 in the Y direction and the rotation of the embroidery frame 9.

The embroidery frame transport device 30 has the second transport mechanism 24 that moves the first drive mechanism 45 in the X direction, and the second motor 27 that drives the second transport mechanism 24, and thus moves the first drive mechanism 45 in the X direction. The embroidery frame transport device 30 can therefore transport the embroidery frame 9 in the X direction.

The present disclosure is not limited to the above-described embodiment and various modifications are possible. For example, the specified position is the position in which the carriage 50 has moved to the front end portion of the drive range (refer to FIG. 4), but the specified position may be another position of the Y direction.

For example, another configuration, such as a belt or the like, that can drive the first transport mechanism 46 and the second transport mechanism 24 may be provided in place of the first motor 49 and the second motor 27.

The drive gear 483 is switched between the first position and the second position by the solenoid 487, but the present disclosure is not limited to this example. For example, the drive gear 483 may be switched between the first position and the second position by a motor or another actuator.

The regulation portion 43 may have another configuration, so long as the regulation portion 43 regulates the movement of the carriage 50 in the Y direction when the embroidery frame 9 is rotated by the rotary drive mechanism 47, and regulates the rotation of the embroidery frame 9 when the carriage 50 is transported in the Y direction by the first transport mechanism 46. For example, the plate spring 436 need not necessarily be provided and a plate spring that regulates the rotation of the second driven gear 472 may be provided on the carriage 50. Further, when the embroidery frame 9 is rotated by the rotary drive mechanism 47, a mechanism that stops the rotation of the first pulley 462 by an action of a solenoid may be provided, and when the carriage 50 is transported in the Y direction by the first transport mechanism 46, a mechanism may be provided that stops the second driven gear 472 or the frame gear 934 by an action of a solenoid. Alternatively, the regulation portion 43 need not necessarily be provided.

The configuration of the first drive mechanism 45 may be another configuration, as long as it is a configuration that transports the carriage 50 in the Y direction and rotates the embroidery frame 9 that is supported by the carriage 50.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame transport device comprising:

a carriage to which an embroidery frame is configured to be removably attached, the embroidery frame being capable of rotating;

a first drive portion that includes a first transport mechanism that transports the carriage in a first direction, and a first drive source that is provided separately from the carriage and that drives the first transport mechanism;

a drive switching portion that shuts off transmission of drive power to the first transport mechanism from the first drive source when the first drive portion transports the carriage to a specified position in the first direction; and a rotary drive portion that causes the embroidery frame to rotate using the drive power of the first drive source, in a state in which the transmission of the drive power from the first drive source to the first transport mechanism is shut off by the drive switching portion.

2. The embroidery frame transport device according to claim 1, wherein the drive switching portion includes a switching portion that shuts off the transmission of the drive power from the first drive source to the first transport mechanism and connects the transmission of the drive power from the first drive source to the rotary drive portion, and an actuator that drives the switching portion.

3. The embroidery frame transport device according to claim 2, wherein the first drive source is a motor, the switching portion includes a spline shaft that rotates due to driving of the motor, and a drive gear that is provided around the spline shaft, that is configured to move in an axial direction of the spline shaft as a result of an operation of the actuator, and that rotates in accordance with a rotation of the spline shaft, the first transport mechanism includes a first driven gear that is capable of meshing with the drive gear, a first pulley that rotates in accordance with a rotation of the first driven gear, a second pulley that is provided separated from the first driven gear in the first direction, and a belt that is stretched over the first pulley and the second pulley and that is connected to the carriage, and the actuator, by causing the drive gear to move in the axial direction, switches a position of the drive gear between a first position and a second position, the first position being a position in which the drive gear meshes with the first driven gear, and the second position being a position in which the drive gear is separated from the first driven gear.

4. The embroidery frame transport device according to claim 3, wherein the rotary drive portion includes a second driven gear that is capable of rotating a frame gear provided on the embroidery frame and that is provided on the carriage, and the second driven gear meshes with the drive gear when the drive gear is in the second position, and causes the embroidery frame to rotate by transmitting a drive power of the drive gear to the frame gear.

5. The embroidery frame transport device according to claim 1, further comprising:

a first regulation portion that regulates movement of the carriage in the first direction when the embroidery frame is being rotated by the rotary drive portion; and a second regulation portion that regulates the rotation of the embroidery frame when the carriage is being transported in the first direction by the first transport mechanism.

6. The embroidery frame transport device according to claim 1, further comprising:

a second transport mechanism that transports the first drive portion in a second direction that is different to the first direction; and a second drive portion that includes a second drive source that drives the second transport mechanism.

7. A sewing machine comprising:

a bed portion that is formed such that an embroidery frame transport device is capable of being mounted thereon, the embroidery frame transport device including a carriage to which an embroidery frame is configured to be removably attached, the embroidery frame being capable of rotating;

a first drive portion that includes a first transport mechanism that transports the carriage in a first direction, and a first drive source that is provided separately from the carriage and that drives the first transport mechanism;

a drive switching portion that shuts off transmission of drive power to the first transport mechanism from the first drive source when the first drive portion transports the carriage to a specified position in the first direction; and a rotary drive portion that causes the embroidery frame to rotate using the drive power of the first drive source, in a state in which the transmission of the drive power from the first drive source to the first transport mechanism is shut off by the drive switching portion.

* * * * *